United States Patent [19]

Manuel et al.

[11] Patent Number: 4,722,290

[45] Date of Patent: Feb. 2, 1988

[54] SEWING MACHINE WITH A WORKPIECE ALIGNMENT DEVICE

[75] Inventors: Karl-Ludwig Manuel; Werner Striegler, both of Kaiserslautern, Fed. Rep. of Germany

[73] Assignee: Pfaff Industriemaschinen AG, Fed. Rep. of Germany

[21] Appl. No.: 62,955

[22] Filed: Jun. 16, 1987

[30] Foreign Application Priority Data

Jun. 20, 1986 [DE] Fed. Rep. of Germany ..... 3620801

[51] Int. Cl.[4] ..... D05B 35/10; D05B 24/04; D05B 69/30

[52] U.S. Cl. ..... 112/153; 112/221; 112/309

[58] Field of Search ..... 112/153, 152, 221, 308, 112/309, 220

[56] References Cited

U.S. PATENT DOCUMENTS

| | | | |
|---|---|---|---|
| 2,791,483 | 2/1961 | Cordier | 112/309 |
| 3,598,070 | 8/1971 | Rosenberg | 112/309 |
| 3,799,087 | 3/1974 | Beamish et al. | 112/309 X |
| 3,970,017 | 7/1976 | Babson et al. | 112/153 X |

FOREIGN PATENT DOCUMENTS

| | | | |
|---|---|---|---|
| 3048198 | 7/1982 | Fed. Rep. of Germany | 112/308 |
| 3139426 | 9/1983 | Fed. Rep. of Germany . | |

*Primary Examiner*—H. Hampton Hunter
*Attorney, Agent, or Firm*—McGlew and Tuttle

[57] ABSTRACT

A sewing machine with a workpiece alignment device for the automatic stitching of workpieces with convex edge sections has a stepwise feed mechanism and an alignment tool operating alternately with the feed mechanism. The tool rotates the workpiece around the axis of the needle when the needle pierces the material, and holds it resting against a guide rule. The alignment tool is driven by drive mechanisms positively connected to one another, because of which the sewing machine can be operated at a relatively high speed.

12 Claims, 5 Drawing Figures

SEWING MACHINE WITH A WORKPIECE ALIGNMENT DEVICE

BACKGROUND OF THE INVENTION

Field of the Invention

This invention relates, in general, to sewing machines and, in particular, to a new and useful drive mechanism for advancing a workpiece of a sewing machine and to a method of sewing a workpiece which has an edge which is convex.

German Pat. No. 31 39 426 discloses a sewing machine that is equipped with a workpiece alignment device for stitching workpieces with convex border sections parallel to the edge. The alignment device has a driver for the workpiece that can rotate around the axis of the needle and can be moved upward and downward between a rest position and an operating position, that can rotate in preset angular steps with the help of an edge-sensing device and a motor subject to a control circuit. The alignment device always operates only when the sewing machine is at a standstill and with the needle piercing the workpiece, with the needle serving as the axis of rotation for the workpiece.

The best approximation of the stitching form to an arc-shaped border section is produced when the workpiece after each stitch is rotated by the alignment device by the necessary angle for the tangential alignment of the edge of the workpiece. However, since the stitching time in this case for an arc-shaped border section would be extraordinarily long because of the frequent stopping of the sewing machine, the workpiece is rotated in each case by an angle of such a magnitude that at least two or three stitches can preferably be formed in immediate succession thereafter with the same angular position. However, along with the advantage of the time saved in this way is the disadvantage that the stitch shape in this case only very incompletely matches the circular shape of a border section and has an unattractice angular appearance.

German Pat. No. 1,292,485 considered in the formulation of the descriptive section discloses a sewing machine for producing stitches parallel to the edge of workpieces with irregular edge shapes. The sewing machine has a material feed operating stepwise and a workpiece alignment device operated by an edge-scanning device and a control circuit. The alignment device includes a control wheel attached below the workpiece that is constantly subject to the control circuit, and a pressure roll placed with a spring action on the presser foot system located above the workpiece, which acts together with the control wheel. With the material feeder lowered, the pressure roll acts on the workpiece with full force and thereby causes the control wheel to exert a torque on the workpiece and because of this, it can rotate around the needle that is lowered during this time. During the feed phase, the material feeder in raised position here lifts the presser foot and the mount of the pressure roll on the presser foot system with it, so that the force of the pressure roll is reduced to such an extent that no torque is exerted by the control wheel on the workpiece.

Since the pressure roll, its mount, and the spring acting on it constitute an oscillatory spring-weight system, there is the danger that resonant vibrations may occur at certain speeds of the sewing machine, from which the time variation of the force of the pressure roll derived from the motion of the material feeder would get out of phase with the motion of the feed dog.

Because of the principle of operation of the alignment device operating as a regulator, the stitch actually formed oscillates around the desired stitching line parallel to the edge. This happens not only with workpieces with irregular edge shapes, but also when the edge is composed of simple geometric shapes such as lines and arcs with the same radius. For the deviations not to be too large, the edge-scanning device must be provided with a rapidly reacting and precisely controllable drive motor for the control wheel, i.e., a relatively high technical expense has to be incurred.

SUMMARY OF THE INVENTION

The invention provides a sewing machine with a workpiece alignment device used for stitching arcs for stitching workpieces with convex border sections parallel to the edge, for example, round cuffs, in which the arrangement and the drive of the alignment tool are designed so that its motion is always exactly in tune with the motion of the feed mechanism, regardless of the speed of the sewing machine.

In the sewing of circular border sections, the alignment tool driven in phase with the stitching in the operating position, lifted away from the workpiece during the feed phase, and in contact with the workpiece in the nonfeed phase, produces a rotary motion of the workpiece only when pierced by the needle. The angular amount of rotary motion depending on the length of the horizontal component of motion of the alignment tool is matched in such a way to the radius of curvature of the circular section to be stitched that the edge of the workpiece is aligned tangentially to the direction of feed before each new feed step. Since the drive mechanisms of the alignment device are positively connected to one another, a forced motion cycle is obtained for the alignment tool, so that the alignment device can also be used with fast sewing machines.

In an embodiment of the invention, there is a particularly simple refinement of the alignment device in which the motion of the alignment tool is produced by the fact that the alignment tool is placed on an eccentric rod that is held in a bearing that permits rotational and displacement motions at the same time. The pressure medium cylinder here serves to move the alignment tool from the rest position for the formation of straight sections of stitches into the operating position for forming arc-shaped sections of stitches, and the reverse. The pressure medium cylinder also makes it possible for the path of motion of the alignment tool to adapt to the plane of the needle plate support surface while engaged with the workpiece lying on the needle plate, by being shifted with the piston of the pressure medium cylinder relative to its housing.

The refinement pursuant to claim 3 permits a low-weight arrangement of the pressure medium cylinder on the rod supporting the alignment tool.

In accordance with another embodiment of the invention, a beneficial design of the drive mechanism for the cam is produced by the fact that the drive motion for the cam is taken from the crank mechanism for the needle bar that is present anyhow.

The arrangement in which a sleeve holding the carrier rod can be adjusted vertically allows the adaptation of the length of the horizontal component of motion of the alignment tool to the particular magnitude of the radius of curvature of the section of arc to be stitched.

The alignment characteristic of the alignment device can be improved substantially by using a guide rule, if the horizontal component of motion of the alignment tool is chosen to be longer than would conform to the radius of curvature of the section of arc to be stitched. Since the workpiece in this case is rotated by a larger angle with each alignment process than would actually be necessary for stitching parallel to the edge, the edge of the workpiece is pressed against the guide rule. A shallow wave can then form in the workpiece in front of the guide rule, which is limited by any holddown device that may be used and is again formed when the alignment tool is lifted off. Because of the sharper rotation or pressure of the workpiece on the guide rule, a larger number of sections of arc with different radii of curvature can be stitched without changing the length of the horizontal component of motion of the alignment tool, and stitches exactly parallel to the edge can also be formed when the sections of arc differ from circular shape.

Accordingly, it is an object of the invention to provide a device for effecting sewing of a seam along an edge of a workpiece which includes driver member which is carried by a carrier pivotally mounted on the sewing machine and which is operable by the drive mechanism of the sewing machine to periodically engage the workpiece during times at which it is held by the needle of the sewing machine and released by a feed drive dog so as to turn the workpiece.

A further object of the invention is to provide a carrier mechanism which includes a driver which is automatically engaged with the workpiece during times at which a feed dog is disengaged therefrom to begin the turning of the workpiece as it is being fed and to subsequently stop the operation thereof subsequently.

A further object of the invention is to provide a sewing machine a device for effecting the turning of a workpiece to form a seam along a convex edge thereof which is simple in design, rugged in construction and economical to manufacture.

A further object of the invention is to provide a method of sewing a workpiece which has an edge which is convex using a sewing machine having a feed device which grips the workpiece intermittently and advances it into association with the reciprocating needle and using a driver which comprises driving the workpiece at its edge and during at least some of the times when the feed device does not engage the workpiece, contacting the workpiece with the driver to move the workpiece while the needle is engaged in the workpiece to thereby cause it to turn.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

GENERAL DESCRIPTION OF THE PREFERRED EMBODIMENTS

Figure 1:
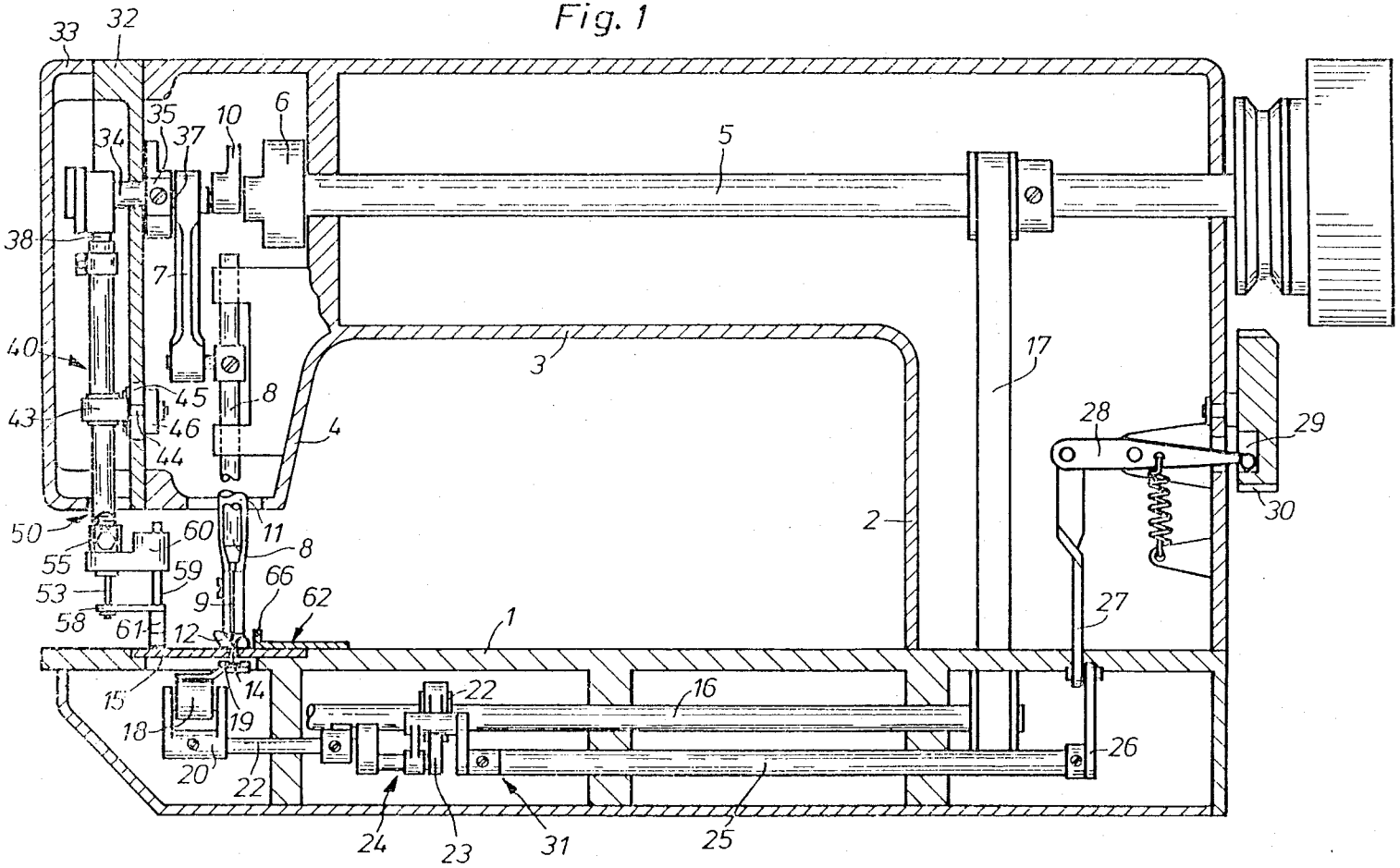
FIG. 1 is a sectional illustration of a sewing machine equipped with the alignment device constructed in accordance with the invention.

Referring to the drawings, in particular, the invention embodied therein comprises a method and device for guiding a workpiece W in respect to its being fed into association with a reciprocating needle 9 of a sewing machine which has a base plate 1 with a needle plate portion 15 over which the work piece is fed. In accordance with the method of the invention, the workpiece W has a convex edge B, is guided as it is sewn by positioning a side edge R1 tangentially to a guide rule 66 as it is being fed by a feed member 19 which engages the workpiece from its underside and advances the workpiece which is held down by a hold-down member 70 which is positioned over the workpiece. In accordance with the feature of the method, the workpiece is gripped intermittently by a driver 61 which is carried by a carrier 40 which is operated from the mechanism of the sewing machine. Thus, while guiding the workpiece at its edge, during at least some of the times when the feed device 19 is not engaged with the workpiece, the driver 61 is made to contact the workpiece and move the workpiece while the needle is engaged in the workpiece so as to cause it to turn.

The sewing machine illustrated in FIG. 1 has a base plate (1), a base (2), and an arm (3) that changes into a head (4). A main shaft (5) mounted in the arm (3) drives a needle bar (8) through a crank (6) and a connecting rod (7); the needle bar carries a thread-guiding needle (9). There is a drive element (10) of a thread dispenser, not illustrated, between the cran (6) and the connecting rod (7). A presser rod (11) that can move up and down is also mounted in the head (4), and carries a presser foot (12).

The needle (9) works together with a gripper (13) that is located beneath a needle plate (15) with a stitch hole (14). The gripper (13) is driven by a drive and a shaft (16), not shown, that is connected to the main shaft (5) by a toothed belt drive (17).

A material feeder (19) is fastened to a support (18) beneath the needle plate (15). The support (18) is supported at one end on a cam, not shown, driven by the shaft (16), which imparts a lifting motion to the material feeder (19) with each stitch-forming process. The support (18) is connected at the other end to a fork-shaped crank (20) that is fastened to an oscillating shaft (21). An eccentric (22) is fastened to the shaft (16) to drive the oscillating shaft (21), with its eccentric rod (23) connected to a connecting mechanism (24) as illustrated and described in detail in German Pat. No. 32 16 993. The connecting mechanism 24 is connected to an adjusting shaft (25) for adjustment, which in turn is connected through a crank (26) and a connecting rod (27) to a lever (28). One end of the lever (28) extends into a groove (29) of a rotating adjusting wheel (30). The connecting mechanism (24) and the subassembly (25 to 30) constitute an adjusting device (31) for varying the size of the feed motion of the material feeder (19).

To the face of the head (4) is fastened a support plate (32) that is covered on the side by a head cover (33). A shaft (34) in line with the main shaft (5) is mounted on the carrier plate (32), with a crank (35) fastened to one end of it and an eccentric (36) shown in FIG. 2 fastened to its other end. The crank (35) is connected to the connecting rod (7) by a pin (37).

The eccentric (36) is enclosed by one end of an eccentric rod (38). The other end of the eccentric rod (38) is held in a hole (39) in a rod (40) that has a longitudinal slit (41) in the area of the hole (39). The eccentric rod (38) is connected securely to the rod (40) by means of a clamping ring (42).

The rod 40 can move in a bushing (43) that is connected securely to a pin (44). The pin (44) is fed through a vertical slit (45) in the support plate (32) and can rotate in a bearing plate (46), while it is held fast axially by a securing ring (47). The bearing plate (46) can be adjusted on the support plate (32) by means of two screws (48), with the screws (48) being held in a vertical slit (49) in the support plate (32).

The bottom section of the rod (40) is designed as a compressed air cylinder(50),in which there is a piston (52) with a piston rod (53) that can move in a longitudinal hole (51) in the rod (40) serving as the cylinder chamber. There is a compression spring (54) in the longitudinal cavity (51) that pushes the piston (52) downward. A connector (55) sealing the longitudinal hole (51) is screwed onto the bottom of the rod (40), with the piston rod (53) passing through it. There is a crossbore (56) and a longitudinal bore (57) corresponding to it in the connector (55), through which the compressed air can be fed into the longitudinal bore (51). A plate (58) is fastened to the bottom of the piston rod (53). A pin (59) fastened to the plate (58) is guided in a shoulder (60) on the connector (55). A rigid driver or alignment tool (61) extending downward is fastened to the bottom of the plate (58), the bottom end of which can be engaged in the workpiece (W) to be processed.

A plate-shaped carrier (62) is fastened to the base plate (1) by means of two screws (63). The screws (63) are located in a slit (64) in the carrier (62) running parallel to the main shaft (5), by which its lateral distance from the presser foot (12) is adjustable. There is a guide rule (66) for the workpiece (W) on an arm (65) of the carrier (62) resting on the base plate (1). There is a pin (68) that can rotate mounted on a bracket (67) extending upward from the carrier (62). A thin plate (69) running diagonally downward is fastened to the pin (68), and ends in a large-area hold-down (70).

The hold-down (70) has a shoulder (71) reaching close to the guide rule (66) and a cutout (72) for the driver (61). A two-arm lever (73) is fastened to the pin (68), with a tension spring (74) anchored to the bracket(67) gripping one end. The tension spring (74) causes the hold-down (70) to rest on the workpiece with slight pressure. A compressed air cylinder (75) that has a thrust member(76) that can move back and forth is fastened to the bracket (67). The compressed air cylinder (75) is arranged so that the thrust member (76) can act together with the other end of the lever (73).

Two adjustable sensors (78,79) are fastened to a support (77) on the head (4), each of which consists of an optical receiver and acts jointly with a reflecting foil (80,81) fastened to the needle plate (15). A light beam emitted by the optical transmitter of the rear sensor (79) falls on a scanning point shown in FIGS. 4 and 5 (82) in front of the presser foot (12) that is directly adjacent to a line (83) passing through the guide surface of the guide rule (66). A light beam emitted by the optical transmitter of the front sensor (78) falls on a scanning point (84) shown in FIGS. 4 and 5 that has a greater distance from the presser foot (12) and a large lateral distance from the line (83).

The two sensors (78,79) are connected through two lines (85,86) to a known control circuit (87) that is illustrated only symbolically for that reason. The control circuit (87) is connected through a line (88) to the switching magnet of a 3/2-way valve (89). The directional control valve (89) is connected through a tube (90) to the connector (55). The source of compressed air is identified as (91).

The sewing machine operates as follows:

Before beginning the sewing, the distance of the stitching from the edge of the workpiece is optionally set by adjusting the lateral distance of the guide rule (66) from the needle hole (14). Since the hold-down (70) is connected to the guide rule (66) through the plate (69), the pin (68), and the carrier (62), the small distance between the shoulder (71) and the guide rule (66) always remains constant.

The size of the stitch length is also optionally set by turning the adjusting wheel (30). If the stitch length is to be maintained with no change from the preceding stitching, or is to be changed only slightly, the vertical adjustment of the rod (40) can also remain unchanged.

Figure 4:
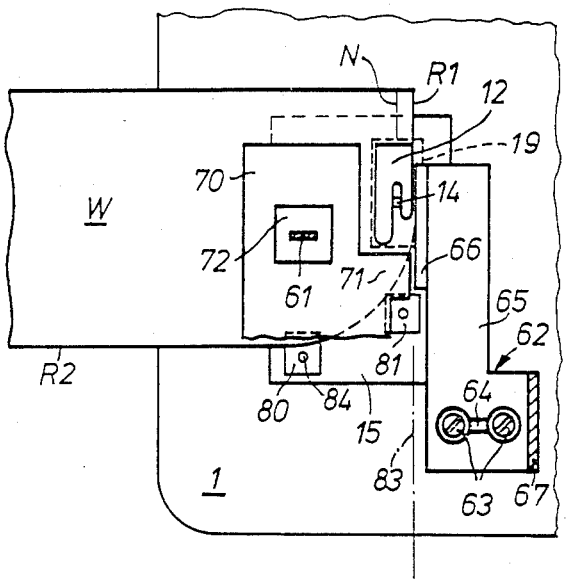
FIG. 4 is a top plan view of a portion of the base plate of the sewing machine and a cuff on it during the sewing of a straight section of stitches.
Figure 5:
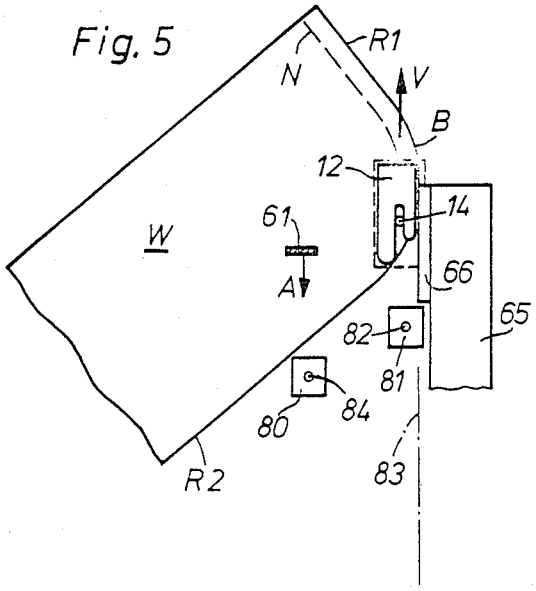
FIG. 5 is a top plan view as in FIG. 4 during the stitching of a convex section of stitches.

The workpiece (W) shown in FIGS. 4 and 5 consists of round cuffs, in which there is a convex edge section or a section of arc (B) between a straight edge (R1) and a straight long edge (R2).

The seam (N) to be made is started at the corner of the side edge (R1). To lay the workpiece (W) on the base plate (1) and the needle plate (15), the presser foot (12) is raised and pivoted upward by the compressed air cylinder (75) of the hold-down (70). After the workpiece (W) is aligned, the presser foot (12) and the hold-down (70) are lowered onto the workpiece and the sewing machine is turned on.

Figure 2:
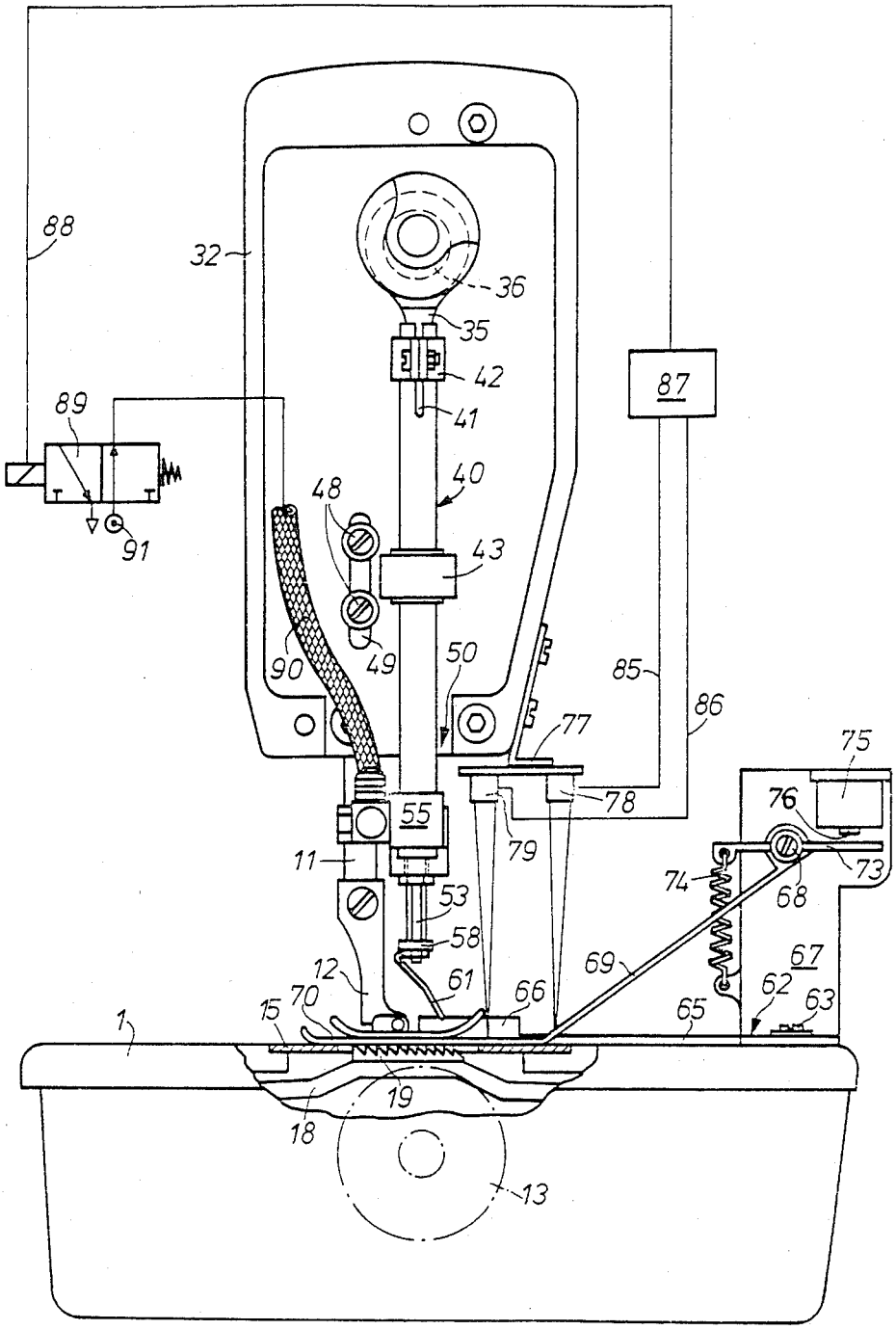
FIG. 2 is an enlarged side elevational view of the sewing machine with the head lid removed.
Figure 3:
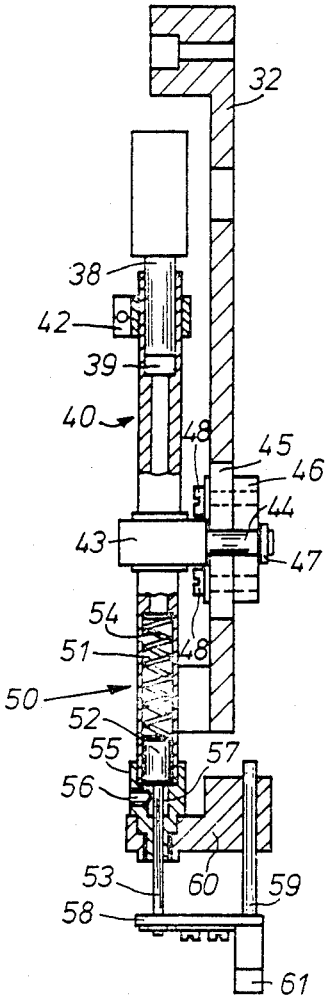
FIG. 3 is an enlarged view in partial cross section of the alignment device.

As long as the scanning point (84) of the sensor (78) is covered by the workpiece (W), the directional control valve (89) remains in the position shown in FIG. 2, in which the compressed air cylinder (50) is pressurized and the driver (61) is raised.

Because of the friction between the hold-down (70) and the workpiece (W), the material feeder (19) executing the feed motion exerts a torque on the workpiece (W), because of which it is automatically kept resting on the guide rule (66) with its side edge (R1).

With the sewing machine running, the main shaft (5) drives the shaft (34) and the cam or eccentric (36) fastened to it synchronously through the connecting rod (7), the pin (37), and the crank (35). The rotating eccentric (36) imparts to the rod (40) an oscillatory motion composed of a periodic longitudinal shift and a periodic pivoting motion around the axis of the pin (44). Because of this oscillatory motion, the bottom end of the driver (61) executes an essentially elliptical motion comprising horizontal and vertical components of motion, with the bottom horizontal component of motion occurring in the direction A according to FIG. 5, which is opposite to the direction of feed V of the material feeder (19). As long as the driver (61) is raised by the compressed air cylinder (50), its motion has no effect on the alignment and motion of the workpiece (W).

As soon as the long edge (R2) of the workpiece (W) has moved away from the scanning point (84) of the sensor (78), whose distance in the feed direction (V) from the needle hole (14) to be measured corresponds to the magnitude of the radius of the section of arc (B), the sensor (78) produces a switching pulse. Because of this switching pulse, the control circuit (87) causes a changeover of the directional control valve (89), whereupon the compressed air cylinder (50) bleeds and the piston (52) is lowered by the compression spring (54).

The material feeder (19) and the driver (61) operate alternately, i.e., the driver (61) comes into contact with the workpiece (W) only when the material feeder (19) is lowered, and is always lifted away from the workpiece (W) when the material feeder (19) is engaged with the workpiece (W). The driver (61) then imparts to the workpiece (W) a rotary motion oriented counterclockwise according to FIG. 5, around the needle (9) that pierces the workpiece (W) during this time. Because of the rotary motion, the section of arc (B) of the workpiece (W) in the area of the needle hole (14) is pressed against the guide rule (66), and the edge of the workpiece in the area of the needle hole (14) is thereby aligned tangentially to the direction of feed (V).

The height adjustment of the sleeve (43) or of the pin (44) is chosen so that the horizontal component of motion of the driver (61) is somewhat larger than would correspond to the radius of the section of arc (B). Since the driver (61) consequently rotates the workpiece (W) each time by a larger angle than would be necessary for the tangential alignment of the section of arc (B), the area of the workpiece (W) between the driver (61) and the guide rule (66) is somewhat compressed or thrown up into a shallow wave. The compression of the material and the shallow wave with the driver (61) raised can revert again during the feed phase to such an extent that a deformation of the workpiece (W) is prevented.

Because of the sharper rotation or pressure of the workpiece (W) on the guide rule (66), there is a relatively large range in which stitches can be formed exactly parallel to the edge without changing the horizontal component of motion of the driver (61). In other words, sections of arc with a larger range of radius or sections of arc with a contour differing from the circular shape can be stitched without changing the setting of the bushing or sleeve (43).

When the stitching of the section of arc (B) is complete, the driver (61) has rotated the workpiece (W) so far that it covers the scanning point (82) of the sensor (79) and its long edge (R2) runs parallel to the direction of feed (V).

As soon as the scanning point (82) is covered, the sensor (79) emits a switching pulse. Because of this switching pulse, the control circuit (87) causes the directional control valve (89) to switch back into the position illustrated in FIG. 2. The result of this is that the piston (52) with the driver (61) is lifted into an inactive position, whereupon the stitching of the straight long edge (R2) can be continued without interruption.

Because the driver (61) can be brought into position and brought out of position with the help of the two sensors (78,79), a seam parallel to the edge consisting of straight and arc-shaped sections can be produced completely automatically in combination with the hold-down (70).

Since the driver (61) is driven by driving mechanisms (crank 35, pin 37, eccentric 36, eccentric rod 38) connected positively to one another, and the sewing machine does not have to be shut down either between the individual rotary motions of the driver (61) or when changing from a straight to an arc-shaped section of edge, or conversely, from an arc-shaped to a straight section of edge, the sewing machine can be operated at a relatively high speed and the entire seam can thus be formed in a comparatively short time.

While specific embodiments of the invention have been shown and described in detail to illustrate the application of the principles of the invention, it will be understood that the invention may be embodied otherwise without departing from such principles.

What is claimed is:

1. In a sewing machine for stitching workpieces having a convex border section parallel to its edge and with a needle bar that can be driven by the main shaft of the sewing machine and a feed device with at least one feed mechanism operating stepwise to provide a non-feed phase and a feed phase and which also includes a needle plate over which the workpiece is fed, the improvement comprising a carrier having an alignment device including an alignment tool located adjacent the feed mechanism and active during the non-feed phase of the feed device and above the needle plate and being movable relative to the needle plate between a rest position and an operating position, drive mechanism means connected between the main shaft and said carrier and said alignment tool in such a way that said alignment tool executes a motion composed of a horizontal component and a vertical component in a plane perpendicular to the plane of the needle plate and parallel to the direction of feed of the feed mechanism.

2. In a sewing machine according to claim 1, wherein said carrier comprises a rod extending substantially vertically, means supporting said rod for axial and rotatable movement in said carrier, sewing machine cam mounted on said sewing machine rotating synchronously with the main shaft and engageable with the upper end of said rod and supporting a lower end of said alignment tool which can be moved upwardly and downwardly relative to said rod by a pressure medium cylinder.

3. A sewing machine according to claim 1, wherein said carrier includes a tubular portion, an adjustable bushing mounted on said sewing machine and carrying said carrier tubular portion, said bushing and said tubular portion being rotatable, drive means connected between said carrier and the sewing machine main shaft for pivoting the carrier in timed relationship to the rotation of said main shaft, a piston movable in said cylindrical portion of said carrier, and a pressure medium cylinder in which said piston is movable, said piston rod portion being extensible from said carrier to move said alignment tool into and out of engagement with the workpiece.

4. A sewing machine according to claim 3, wherein said drive mechanism includes a rotatable shaft portion, a cam mounted on said shaft portion and rotatable therewith to drive said carrier, a crank driven by said cam operable to drive the needle bar.

5. A sewing machine according to claim 4, wherein said carrier includes a sleeve holding a rod, said rod being adjustable in said sleeve.

6. A sewing machine according to claim 1, including a guide roll arranged alongside the workpiece, the needle plate having a stitch hole opposite the alignment tool.

7. A drive mechanism for a sewing machine having a rotatable shaft drive, a feed mechanism which operates to periodically engage a workpiece positioned on a support of the sewing machine and to feed it into association with a needle reciprocating over the support for sewing the workpiece, comprising a hold-down engageable with the workpiece to hold it on the support, a driver carrier pivotally supported on the sewing machine intermediate its length, a driver carried by said carrier displaceable relative to said carrier having an alignment tube portion which is movable into engagement with the workpiece periodically so as to engage it at a spaced location from the needle at times when the feeding means is not engaged to feed the workpiece and to thereby turn the workpiece whenever it is engaged with the needle, and drive means connected between the rotatable shaft and said carrier and said driver for moving said carrier and said driver to periodically engage the workpiece when it is not engaged with the feed mechanism.

8. A method of sewing a workpiece having an edge which is convex and using a sewing machine having a feed device which grips the workpiece intermittently and advances it into association with a reciprocating needle and using a driver, comprising guiding the workpiece at its edge, and during at least some of the times when the feed device does not engage the workpiece, contacting the workpiece with the driver to move the workpiece while the needle is engaged in the workpiece and thereby to cause it to turn.

9. A method according to claim 8, wherein two scanning devices are used to scan the edge of the workpiece as it is advanced and when the convex edge is positioned adjacent a guide, activating the driver to move it into engagement with the workpiece until the convex edge is completely sewn and a second scanner is used to sense when the convex portion of the workpiece has gone beyond it to lift the driver off the workpiece.

10. A method according to claim 8, wherein a guide rule is used to place the long side edge of the workpiece, and the workpiece is maintained along the edge of the guide rule during a time at which it is sewn and turned.

11. A method according to claim 8, including holding the top of the workpiece downwardly on a needle plate as it is being sewn.

12. A method according to claim 11, including periodically lifting the hold-down to free the workpiece.

* * * * *